United States Patent [19]

Nichols

[11] 4,032,048

[45] June 28, 1977

[54] BIN WITH INTERNAL SLOPING WALLS

[75] Inventor: Dwight E. Nichols, Beatrice, Nebr.

[73] Assignee: Hoover Ball and Bearing Company, Saline, Mich.

[22] Filed: Dec. 29, 1975

[21] Appl. No.: 644,591

[52] U.S. Cl. ..... 222/185
[51] Int. Cl.[2] ..... B67D 5/06
[58] Field of Search ..... 222/181, 185, 556

[56] References Cited

UNITED STATES PATENTS

| | | | |
|---|---|---|---|
| 2,774,515 | 12/1956 | Johansson et al. | 222/185 |
| 3,138,297 | 6/1964 | McKinney | 222/185 |
| 3,729,121 | 4/1973 | Cannon | 222/185 |

*Primary Examiner*—Stanley H. Tollberg
*Attorney, Agent, or Firm*—Olsen and Stephenson

[57] ABSTRACT

A bin for storing and transporting bulk material having a pair of sloped internal walls which direct contents of the bin toward a discharge opening in the bottom wall. A feed opening is provided in one of the internal walls in substantial vertical alignment with the discharge opening and a door is pivotally mounted on the underside of the wall so that it can be moved to a latched position closing the feed opening. A gasket retained in a channel on the door cooperates with flanges that are formed on the internal walls at positions surrounding the feed opening to provide a dust tight seal between the door and the internal walls of the bin.

2 Claims, 3 Drawing Figures

BIN WITH INTERNAL SLOPING WALLS

BACKGROUND OF THE INVENTION

Side wall and bottom wall discharge bins of the type shown in U.S. Pat. Nos. 2,648,428 and 3,104,035 and slope bottom bins of the type shown in U.S. Pat. NO. 3,329,317, have been used extensively for storing and transporting bulk material. The principal problem that has been encountered with the side and bottom wall discharge bins is that it has been necessary to provide a door over a discharge opening on the side or bottom of the bin. In normal handling of the bin during transport and storage, these doors experience considerable banging around and general rough useage by fork lift operators and others,. This makes it difficult to maintain a dust tight seal between the door and the bin due to the extensive abuse of the door. Also, many of the prior art bins of the side wall and bottom wall discharge type have required special equipment for discharging the bin contents. Rapid discharge of the slope bottom bin shown in the above patent is impossible because it has a discharge opening of very small size. It is an object of the present invention, therefore, to provide an improved self-emptying bin with an internal discharge opening and door arrangement that is protected from rough handling and thereby insures an improved door seal over a prolonged service life of the bin.

SUMMARY OF THE INVENTION

In the slope bottom bin of this invention, a horizontal bottom wall is provided and the bin discharge opening is formed therein. The bin has the usual vertical side walls and a pair of sloped internal walls each being secured at its upper end to one of the side walls and having its lower end located adjacent to and above the bottom wall. A feed opening is provided in one of the internal walls in vertical alignment with the discharge opening. A door underlies the feed opening and is hingedly secured to one of the internal walls. A latch cam is rotatably mounted on the door and coacts with a stop on the other internal wall to provide a means of retaining the door in a closed position when it is desired to close the feed opening. A gasket retaining channel containing a resilient gaskt member is provided on the door and a flange projects outwardly from the internal walls toward the channel so that in the closed position of the door the flange penetrates the gasket member to thereby form a dust tight seal between the internal walls and the door.

Thus, to discharge the contents of the bin of this invention, the latch cam is rotated and the door swung downward away from the feed opening to an open position in which it extends downwardly through the discharge opening. The internal walls then act as a hopper to direct the bin contents through the feed openings. During transport of the bin, the door is swung upward to a closed position in which it remains above the bottom wall and out of the way of the fork lift operator. The bottom wall thus protects the door against damage during transport and storage of the bin.

Further objects, features and advantages of this invention will become apparent from a consideration of the following description, the appended claims and the accompanying drawing in which:

Figure 3:
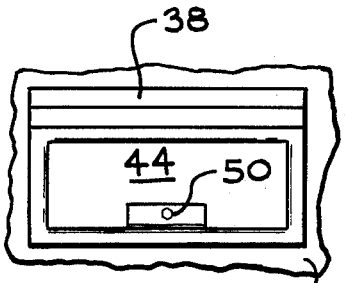
FIG. 3 is a fragmentary detail view of the discharge door portion of the bin of this invention.
Figure 1:
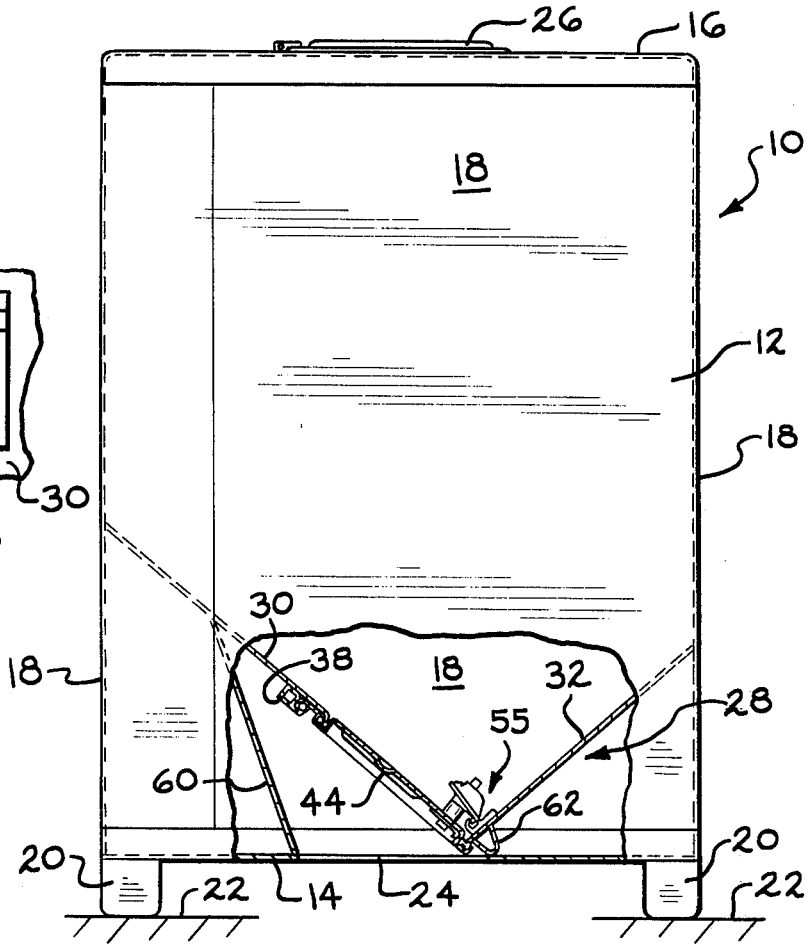
FIG. 1 is a side elevational view of the bin of this invention with some parts broken away and other parts shown in section to better illustrate the internal construction of the bin.

With reference to the drawing, the bin of this invention, indicated generally at 10, is illustrated in FIG. 1 as including a body 12 formed of metal or an equivalent rigid material and having a rectangular bottom wall 14 which is generally horizontal in the floor support position of the bin shown in FIG. 1, a rectangular top wall 16 and four upright side walls 18. The bin is provided with supporting legs 20 which project downwardly from the bottom wall 14 for supporting the bin 10 above a floor or equivalent surface 22. The space between the bottom wall 14 and the floor 22 is sufficient to accommodate the lift tines on a fork lift truck to enable handling of the bin 10 with conventional fork lift equipment. The top wall 16 has a filling opening (not shown) which is closed by a cover 26 during transport and storage of the bin 10. The bottom wall 14 has a discharge opening 24 through which the contents of the bin can be emptied.

The improved bin 10 of this invention is provided with an internal hopper assembly 28 comprising a pair of downwardly inclined internal walls 30 and 32 arranged in a substantially V-formation within the bin body 12 at a position above the bottom wall 14. Each of the walls 30 and 32 is secured at its upper end to one of the side walls 18 at a position substantially below the top wall 16 and has its lower end positioned just above the bottom wall 14. The side edges of the walls 30 and 32 are secured to opposite ones of the side walls 18. The internal wall 30 is formed with a rectangular feeding opening 34 bounded by a flange 36, the purpose of which will shortly be explained.

Figure 2:
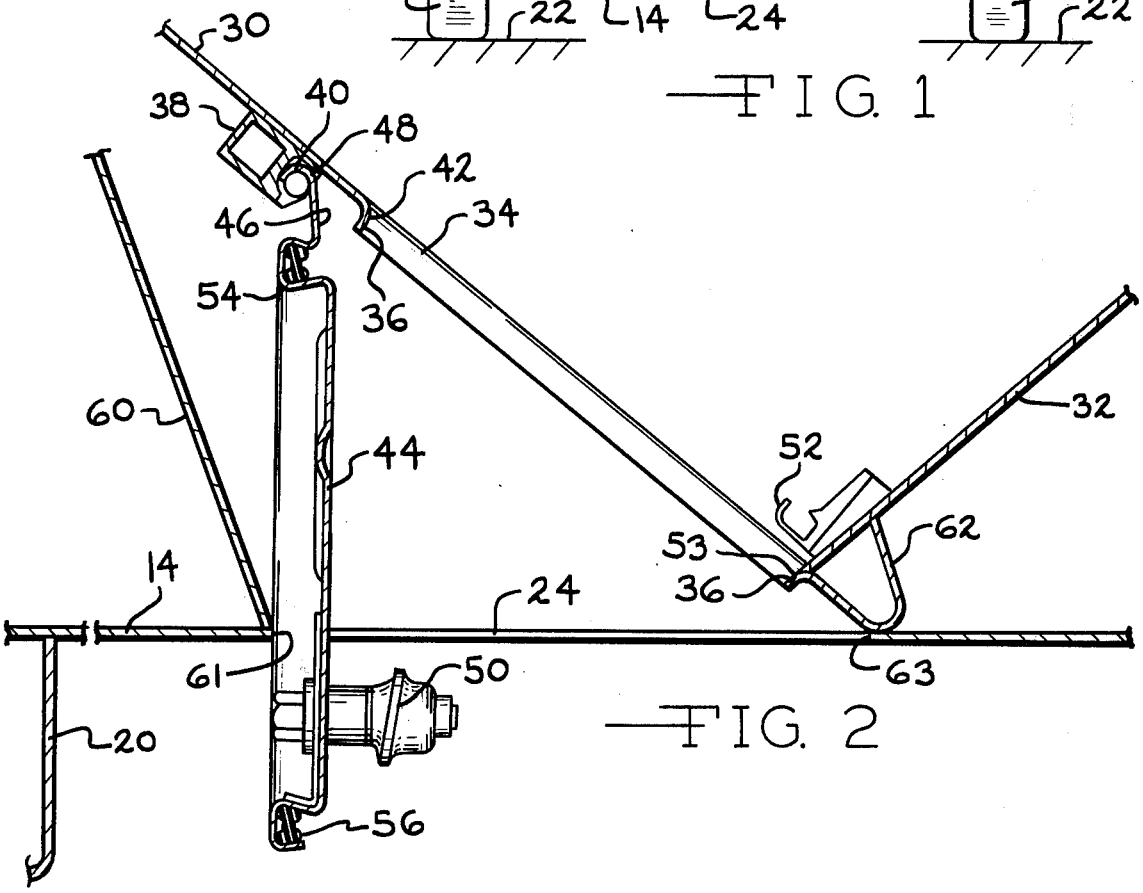
FIG. 2 is an enlarged fragmentary view of the discharge portion of the bin of this invention.

A hinge bar 38 having an internal arcuate surface 40 is secured to the underside of the internal wall 30 adjacent the upper edge 42 of the feeding opening 34. A discharge door 44 has an upper extension 46 which terminates in an arcuate end portion 48 hingedly supported on the hinge bar surface 40 so that the door 44 is pivotally movable between the downwardly extending open position shown in FIG. 2 and the inclined closed position shown in FIG. 1. As shown in FIG. 2, the door 44, in its open position, projects downwardly through the discharge opening 24 to a point below the bottom wall 14 which is above the lower ends of the legs 20. This prevents the door 44 from striking the floor 22 in the open position of the door shown in FIG. 2.

A cam assembly 50 is rotatably supported on the door 44 for engagement with a stop member 52 secured to the internal wall 32 at a position adjacent the lower edge 53 of the feed opening 34. The cam assmebly 50 and the stop member 52 form coacting parts of a releasable latch assembly 55 operable to releasably maintain the door 44 in its closed position shown in FIG. 1. The latch assembly per se forms no part of the present invention and is described in greater detail in U.S. Pat. No. 3,130,855, dated Apr. 28, 1964, and assigned to the assignee of this application.

The door member 44 is formed with a rectangular channel 54 in which a compressible gasket 56 is confined. The rectangular gasket 56 is shaped and dimensioned to correspond size and shape to the rectangular flange 36 which surrounds the feed opening 34. As a result, in the closed position of the door 44, the flange 36 bites into and compresses the gasket 56 so as to insure a dust tight engagement of the door 44 with a hopper assembly 28. This dust tight engagement precludes undesirable leakage of material from the bin 10 during transport and storage. The structure and adavantage of a rectangular gasket and flange assembly is described in greater detail in co-pending application Ser. No. 327,143, filed Jan. 26, 1973, also owned by the assignee of this application.

An internal partition 60 extends upwardly from the edge 61 of the discharge opening 24 and is secured to the underside of the internal wall 30. Another irregularly shaped partition member 62 extends upwardly from the opposite edge 63 of the discharge opening 24 and is secured to the internal wall 32 so as to form the flange 36 at the lower edge 53 of the feeding opening 34. The partitions 60 and 62 cooperate to form a conduit extending between the hopper assembly 28 and the bottom wall 14. The conduit confines the movement of granular material from within the bin body 12 to movement through the discharge opening 24 without opportunity for the granular material to accummulate on ledges and surfaces where it will not be directed through the discharge opening 24.

From the above description, it is seen that this invention provides an improved bin 10 in which the movable discharge door 44 is protected by the bottom wall 14 from contact with handling equipment such as fork lift trucks. The tines on a fork lift truck engage the bottom wall 14 and thus never contact the door 44 so as to eliminate the likelihood of door damage during handling. Further, the bin 10 is readily discharged by rotating the cam assembly 50 to allow movement of the door 44, under the weight of the bin contents, to the open position shown in FIG. 2. Discharge of the bin contents then takes place under the force of gravity through the bin discharge opening 24 without the necessity for any special bin handling or bin discharge equipment.

It is claimed:

1. A bin for storing and transporting bulk material comprising a bin body having a generally horizontal bottom wall having a discharge opening formed therein, a top wall, side walls extending between said top and bottom walls, and body support legs on said bottom wall, an internal hopper assembly in said body below said top wall consisting of two inclined walls arranged in a generally V-formation for directing all bulk material in said body toward said discharge opening, each of said internal walls having the upper end thereof secured to one of said side walls at a position substantially above said bottom wall and having the lower end thereof located adjacent to and above said bottom wall, means in one of said internal walls forming a feed opening located directly above said discharge opening so that bulk material flowing downwardly in said bin through said feed opening will fall through said discharge opening, a door member pivotally mounted on the underside of said one internal wall for movement between closed and open positions with respect to said feed opening, said door member in the open position thereof extending downwardly through said discharge opening, and coacting releasable latch means on said door member and said one internal wall operable to secure said door in said closed position relative to said feed opening.

2. A bin according to claim 1 further including partition members connected to and extending between said hopper assembly and said bottom wall at positions on opposite sides of said discharge opening so as to form a discharge conduit extending between said hopper assembly and said discharge opening.

* * * * *